United States Patent [19]

Gressett, Jr. et al.

[11] Patent Number: 4,768,415

[45] Date of Patent: Sep. 6, 1988

[54] TREMOLO BRIDGE FOR GUITARS

[75] Inventors: Charles A. Gressett, Jr., Brea; John F. Page, La Mirada; Daniel J. Smith, Placentia; John Carruthers, Venice, all of Calif.

[73] Assignee: Fender Musical Instruments Corporation, Brea, Calif.

[21] Appl. No.: 37,545

[22] Filed: Apr. 13, 1987

Related U.S. Application Data

[62] Division of Ser. No. 697,221, Jan. 31, 1985.

[51] Int. Cl.[4] ..... G10D 3/04

[52] U.S. Cl. ..... 84/298; 84/267; 84/297 R; 84/312 R; 84/313

[58] Field of Search ..... 84/267, 297 R, 298, 84/299, 307, 312 R, 313

[56] References Cited

U.S. PATENT DOCUMENTS

| | | | |
|---|---|---|---|
| 4,079,652 | 3/1978 | Gittier | 84/1.16 |
| 4,385,543 | 5/1983 | Shaw et al. | 84/298 |
| 4,608,905 | 9/1986 | Takabayashi | 84/313 |
| 4,656,915 | 4/1987 | Osuga | 84/313 |

*Primary Examiner*—Lawrence R. Franklin

*Attorney, Agent, or Firm*—Richard L. Gausewitz

[57] ABSTRACT

A tremolo bridge for an electric guitar has a fine tuning mechanism installed thereon. Fine tuning screw heads 43 have coplanar top surfaces 44 which do not rise or fall as tuning is effected. When actuated, heads 43 move screws 47 vertically to act on strings 29 through string securing levers 35. With this structure, the tuning heads form an essentially flat surface providing a seat or rest for the hand or forearm of the guitarist.

5 Claims, 3 Drawing Sheets

TREMOLO BRIDGE FOR GUITARS

This is a division of application Ser. No. 697,221, filed Jan. 31, 1985, for TREMOLO BRIDGE FOR GUITARS.

BACKGROUND OF THE INVENTION

It is highly desirable, in a tremolo apparatus for an electric guitar, to have not only fine tuning but also individual string-height adjustment. Furthermore, it is important to achieve these and other results with a tremolo that is so flat on the upper side thereof, regardless of the positions of the fine-tuning elements, that the musician may, when he wishes, rest his hand or forearm on the tremolo. This is particularly true when the tremolo is one having a removable arm and which is capable of being locked during periods when no tremolo operation is desired.

The tremolo must be such that the various strings will remain on the intonation points even when the tremolo plate is pivoted or tilted upwardly to an extreme position. Otherwise, the tuning of the instrument would be lost during such intervals of extreme tilt-up.

Because of the frequent tendency of guitarists to bend strings in order to achieve sounds somewhat like those generated by a pedal guitar, it is important that such bending produce little or no effect in the strings not bent. In other words, there should be little or no cross talk between the strings, even when very strong bending operations are occurring.

An additional factor, that has been recognized since tremolos for electric guitars were originated, is that the tremolo must return to its initial or "zero" position after the musician releases the tremolo arm. For this to occur, friction in the tremolo apparatus must be reduced to the lowest-possible amount commensurate with ruggedness and mass-producibility.

SUMMARY OF THE INVENTION

In the present tremolo apparatus, the pivot axis is relatively far from the neck of the guitar, so far that longitudinally-adjustable saddles on the tremolo plate may be shifted forwardly to positions at which the intonation points are closer to the neck than is the pivot axis. Furthermore, the pivot axis is high, being only a very small distance below the intonation points. Because of the stated positioning of the pivot axis, even very strong bending of a string does not generate a torque sufficient to effect any substantial pivotal movement of the tremolo plate. The plate therefore stays substantially steady, unless intentionally operated by the guitarist for tremolo action. In addition, pivotal movement of the plate does not cause a large amount of lifting of the intonation points, because when viewed in plan the intonation points are generally in line with the pivot axis, it being understood that the intonation points are adjustable both forwardly and rearwardly in order to achieve proper intonation of the strings.

In accordance with another aspect of the present invention, there is individual string-height adjustment by rotation of saddle elements about horizontal axes, in combination with fine tuning caused by pivoting of levers. Such fine tuning is preferably about the same axes as are employed for the string-height adjustment.

In accordance with another aspect of the invention, means are provided on the sides of the intonation points relatively remote from the neck to cause the strings to bend down closely adjacent the intonation points, the result being that even when the bridge plate is tilted upwardly to an extreme position, the strings remain in firm engagement with the intonation points as is necessary to prevent loss of the tuned condition of the guitar during these intervals.

For fine tuning, levers are tilted by means of screws that do not rotate, adjustment instead being effected by captive screw heads the upper surfaces of which are flat and always remain at the same elevation. These screw heads therefore provide, in combination with the saddles, which are relatively flat on the upper sides thereof, locations on which the guitarist may comfortably rest his hand or forearm.

The pivot axis is formed by short but straight knife-edge elements, which cooperate with pivot blocks that are spaced apart and between which forward portions of the bridge plate and saddles project. This minimizes friction while achieving a high degree of wear resistance.

DETAILED DESCRIPTION OF THE PREFERRED EMBODIMENT

The present tremolo apparatus is incorported in a conventional guitar having a body, a neck projecting from one end of the body, and guitar strings provided over the neck and body. An early classic guitar of this type is illustrated, except for the neck, in Fender U.S. Pat. No. 2,741,146, which is hereby incorporated by reference herein. The guitar and guitar neck are shown in U.S. Pat. No. 4,206,679, which patent also is hereby incorporated by reference herein. However, instead of having the nut shown in U.S. Pat. No. 4,206,679, it is preferred that the present guitar incorporate a locking nut. The preferred nut is described and illustrated in U.S. patent application Ser. No. 697,220, filed on even date herewith, for a "Clamping Nut and Method", inventors Gressett and Page, now U.S. Pat. No. 4,669,350.

The guitar body is shown fragmentarily at 10, and has a recess provided in the upper side thereof in order to receive portions of the tremolo apparatus, particularly the tremolo spring and associated lever arms and spring-adjustment means.

Figure 6:
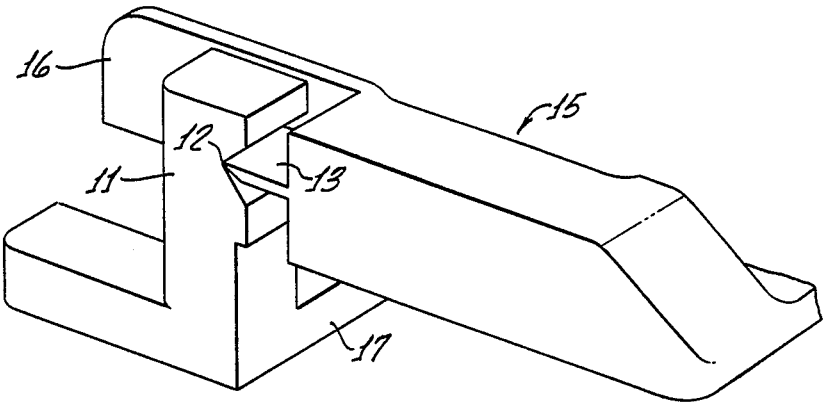
FIG. 6 is a fragmentary enlarged isometric view illustrating a knife edge relationship on one side of the tremolo.
Figure 7:
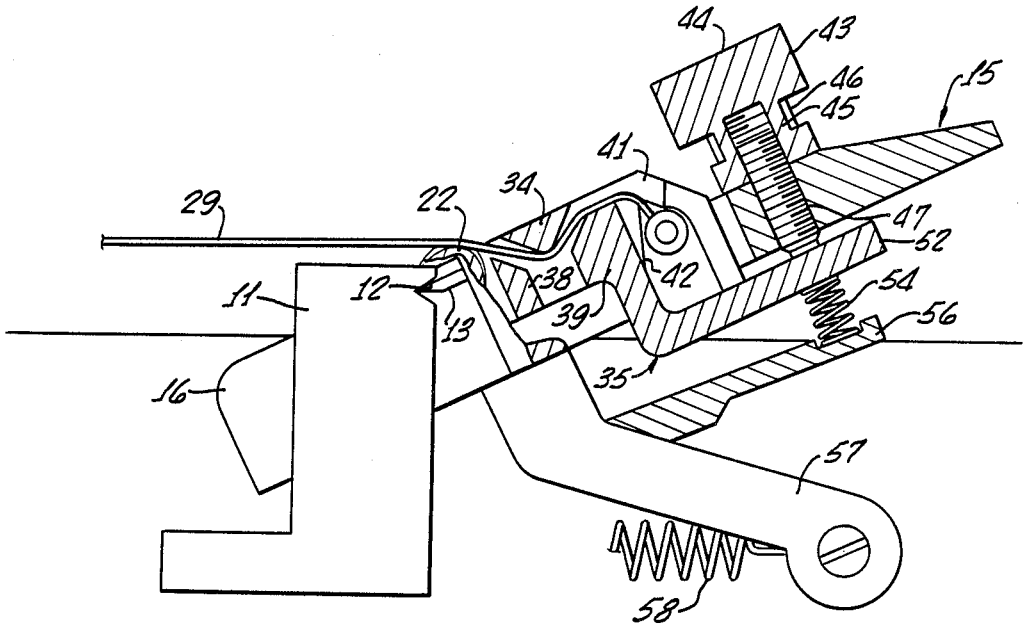
FIG. 7 is a view corresponding to portions of FIGS. 3 and 6, and showing the tremolo plate in an upperly-tilted condition.

Pivot blocks 11 (that are identical to each other, except that they are left and right) are mounted on suitable lands in the recess in body 10, and anchored by means not shown. As best illustrated in FIG. 6, the pivot blocks 11 have V-grooves 12 in the rear sides thereof (the sides most remote from the neck of the guitar). Each V-groove 12 has inserted therein a knife edge 13 as shown in FIGS. 6 and 7. The two V-grooves 12 are in exact alignment with each other along a line perpendicular to the guitar strings. Correspondingly, the two knife edges 13 are in exact alignment with each other, so that the knife edges and V-grooves cooperate to form the pivot axis or fulcrum for the tremolo apparatus.

The spaced-apart knife edges are straight but are short, for example, each is one-quarter inch long. The described elements produce very low-friction but rugged pivotal elements characterized by the ability to withstand much wear. It is pointed out that the use of the word "knife" does not imply such sharpness as to be able to cut most objects, the edges actually being in the nature of dull knives.

Figure 1:
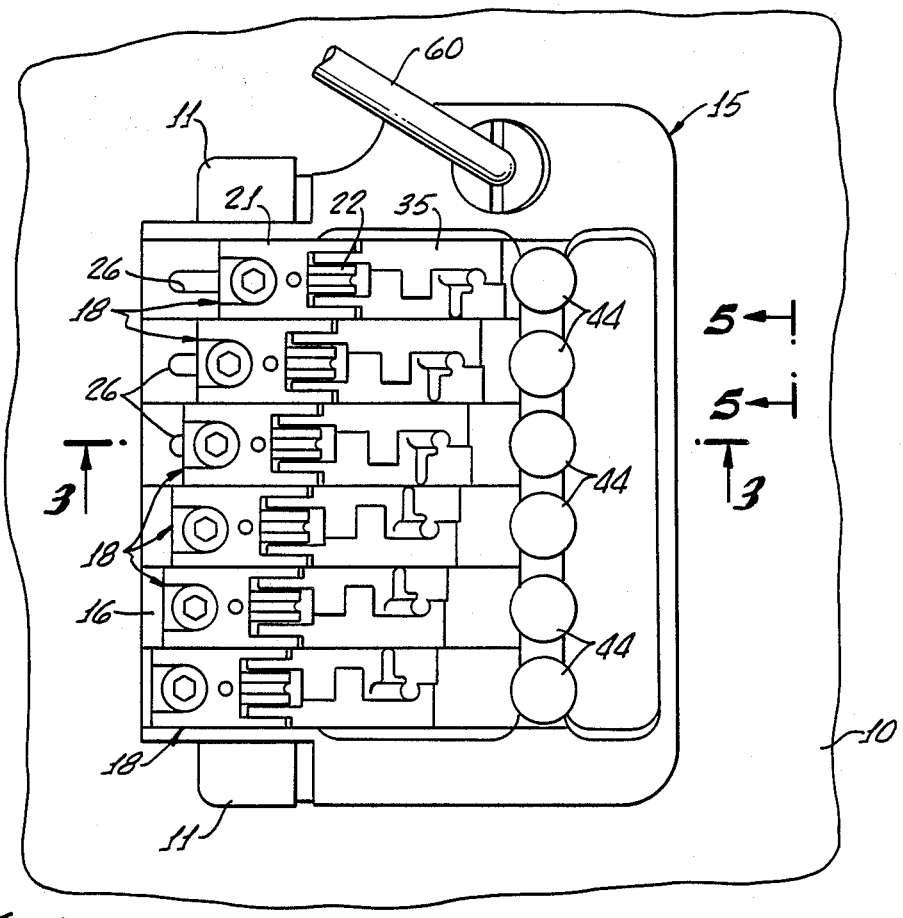
FIG. 1 is a top plan view of a tremolo apparatus incorporating the present invention.

Referring to FIGS. 1 and 6, the pivot blocks 11 are disposed on opposite sides of a forwardly-projecting portion 16 of a tremolo plate 15. Stated otherwise, the forward portion of plate 15 extends between and adjacent the pivot blocks, there being sufficient clearance provided to prevent any drag on the pivotal movement.

As best shown in FIG. 1, the illustrated tremolo plate 15 has a relatively wide portion remote from the neck of the guitar. At the forward and outer regions of such wide portions there are provided the knife elements that define knife edges 13.

Preferably, the two pivot blocks 11 are connected by a cross-element that extends therebetween and is preferably integral therewith. The cross-element extends below the tremolo plate, and is numbered 17 in FIG. 6. Furthermore, centering pins (not shown) are provided at the outer end of each V-groove to confine the sides of the knife edges 13, and prevent any rubbing between the tremolo plate and pivot blocks.

There are provided on both the narrow forward portion 16 of tremolo plate 15, and the wider rear portion of such plate, a plurality of combination lever systems and bridge saddles. Such combinations are numbered 18, and each is identical to the others except that—preferably—those on opposite sides of the central vertical plane of the guitar are "left" and "right" for symmetry of appearance. There being six guitar strings, there are six combination bridge saddle and lever systems 18, the three on one side of the vertical central plane of the guitar being mirror images of the three on the other side thereof.

Figure 3:
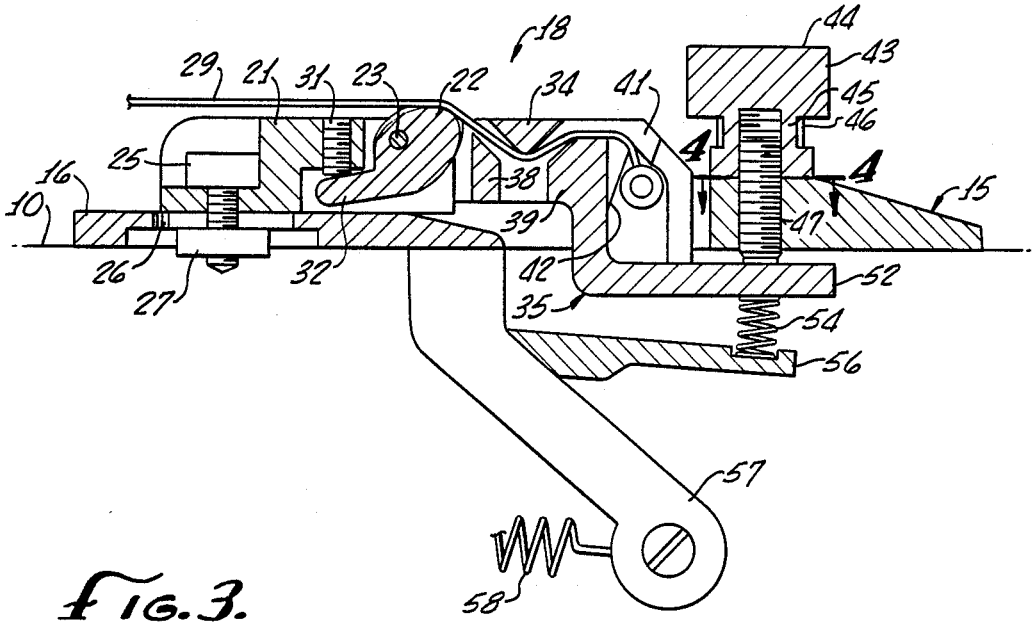
FIG. 3 is an enlarged longitudinal sectional view taken on line 3—3 of FIG. 1.
Figure 2:
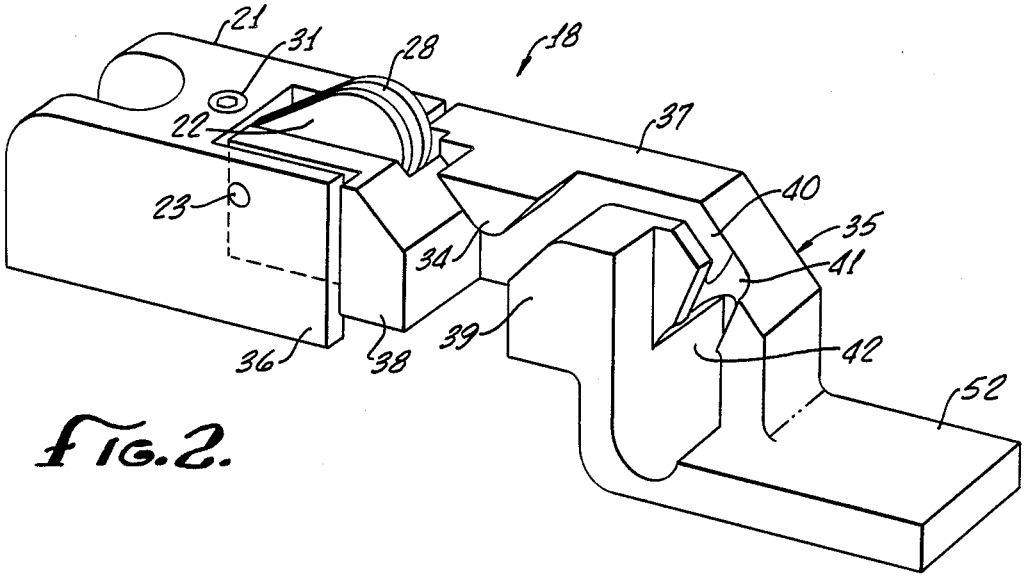
FIG. 2 is a greatly enlarged isometric view of one of the saddle and lever systems incorporated in the present tremolo.

Only one such saddle, being the third from the top in FIG. 1, will be described in detail because of the substantial identity of shapes and functions. Such saddle is shown in enlarged form in FIGS. 2, 3 and 7. Referring first to FIGS. 2 and 3, the forward portion of each combination bridge saddle and lever system 18 (the portion closest to the neck of the guitar, and shown at the left) is a longitudinally adjustable, clampable, saddle block 21 having a string saddle 22 pivotally mounted therein for rotation about a horizontal pin 23. Such pin 23 is parallel to the pivot axis of the tremolo plate.

The saddle block 21 is recessed in its forward portion to receive the head of a clamping bolt 25, such bolt extending downwardly through a longitudinal slot 26 in tremolo plate 15 so that the saddle block and associated elements may be adjusted longitudinally of the guitar strings. The head of bolt 25 has an internal hex socket, and a nut 27 is provided beneath the tremolo plate so as to permit locking of the saddle block 21 in the correct longitudinal position for proper string intonation.

String saddle 22 has a grooved upper portion 28 (FIG. 2) adapted to seat one of the guitar strings 29 (FIGS. 3 and 7). The elevation of the string is determined by the rotated position of saddle 22 about pin 23, the pin 23 being eccentrically mounted relative to the upper saddle portion. To determine the rotated position, a set screw 31 is provided in the saddle block 21, and bears downwardly on a crank portion 32 of saddle 22 (FIG. 3).

It is pointed out that, as shown in FIG. 3, the intonation region, that is to say, the highest region, of the saddle 22—on which the string 29 actually seats—is toward the rear of the saddle, namely the right thereof as shown in FIGS. 3 and 7. Thus, the downward pressure exerted by string 29 on the saddle tends to pivot the saddle clockwise about pin 23, which causes crank 32 to press upwardly against the lower end of set screw 31. Accordingly, the indicated clockwise pressure maintains the crank 32 against the set screw at all times when the guitar is strung, so that rotation of the set screw 31 in either direction (by a suitable wrench inserted into a socket hole at the upper end of the set screw) effects precise elevational adjustment of each individual guitar string.

The location of the intonation point at the rear of saddle 22 provides a further desirable effect in cooperation with a hold-down portion 34 of a lever 35. As best shown in FIGS. 1 and 2, the forward end of lever 35 is bifurcated and fits between ears 36 that project rearwardly from the main body of saddle block 21. The saddle 22, in turn, fits into the bifurcated forward end of the lever 35.

Lever 35 is pivotally associated with the same pin 23 that mounts the saddle element 22.

The above-indicated hold-down portion 34 is integral with lever 35 and extends laterally from one side 37 thereof, reference being made to FIG. 2. The portion of the lever beneath hold-down 34 is void, there being laterally-projecting elements 38 and 39 to the front and rear of the void beneath the hold-down (FIGS. 2, 3 and 7).

The hold-down 34 is preferably generally triangular in section, with its base at the top. It is disposed sufficiently far forwardly, and is sufficiently deep, that the string 29 after passing over saddle 22 in grooved portion 28 will bend downwardly at a angle sufficient to insure firm engagement between the string and saddle regardless of the pivoted position of the tremolo plate. Reference is made to FIG. 7, which shows an upward-pivoted position of the tremolo plate 15.

After passing beneath hold-down 34, the string 29 bends upwardly over the laterally-projecting element 39 in a groove 40 therein (FIG. 2). Then, the string passes downwardly through a notch 41 (FIG. 2) and into a ball-end seat 42. The notch and seat 41 and 42, respectively, open laterally, being so constructed that—in association with groove 40—the harder the string 29 is tensioned the more firmly the ball end at the end of string 29 seats in its seat 42.

To achieve fine tuning of each individual guitar string that passes over the height-adjustable saddle 22, means are provided to pivot each lever 35 about pin 23 without disturbing the substantially flat and uniform condition of the upper portion of the tremolo apparatus. Thus, regardless of the fine tuning, the entire upper portion of the tremolo may serve as a seat or rest for the hand or forearm of the guitarist.

Figure 5:
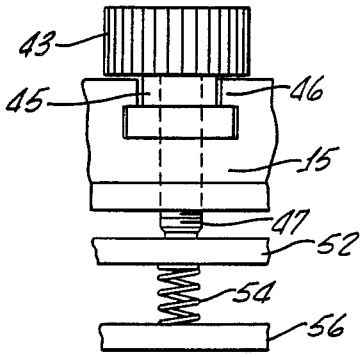
FIG. 5 is a vertical view showing a portion of the tremolo plate and an associated captive nut, the view being from station 5—5 shown in FIG. 1.

Referring to FIGS. 3 and 5, each combination bridge saddle and lever system 18 includes a screw head 43 the upper surface 44 of which is flat and low. Screw head 43 has an annular groove 45 at the lower portion thereof, which groove 45 receives ears 46 (FIG. 5) on plate 15 that hold the screw head 43 captive. It is emphasized that FIG. 5 is a view looking from the tail of the guitar toward the neck thereof, that is to say, toward the left in FIGS. 1 and 3.

Threadedly associated with each screw head 43 is a screw 47. The screw 47 extends downwardly through an unthreaded bore in tremolo plate 15 and bears downwardly against the upper surface of a tail portion 52 of the lever 35. As best shown in FIG. 3, such tail portion 52 is disposed beneath the rear region of the tremolo plate 15.

Figure 4:
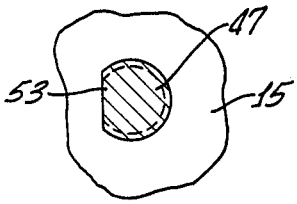
FIG. 4 is a fragmentary horizontal plan view of a portion of the tremolo plate having a fine-tuning screw passed therethrough, reference being made to line 4—4 in FIG. 3.

Referring to FIG. 4, the screw 47 is not cylindrical but instead has a flat or key portion 53 that prevents it from rotating in the tremolo plate. Stated otherwise, the bore in the tremolo plate 15 is D-shaped, and a D-shaped screw fits vertically-slidably therein.

To maintain each lever 35 in upwardly-bearing engagement with the bottom of screw 47, a helical compression spring 54 is seated between the underside of tail 52 and a spring seat in a plate 56 illustrated in FIGS. 3 and 7. The plate 56 extends forwardly and is connected to the underside of tremolo plate 15, being between two cranks or arms 57. There is one such arm 57 on each side of the tremolo plate and connected thereto.

Connected to each crank or arm 57 is a helical tension spring 58 (FIG. 3) that extends forwardly and is anchored within the body 10 of the guitar. For a detailed description of the springs 58 and associated spring-adjustment mechanism, reference is made to patent application Ser. No. 697,219, filed on even date herewith, for a "Tremolo Spring Adjustment Mechanism for Electric Guitars", inventor Gressett now U.S. Pat. No. 4,656,916. The springs 58 counteract the tension of strings 29 to create a floating relationship, so that the tremolo plate remains stationary except when intentionally actuated by a guitarist pressing on the tremolo arm 60 (FIG. 1).

Tremolo arm 60 is removably secured to plate 15 as described in copending patent application Ser. No. 689,715, filed Jan. 4, 1985, for "Snap-End Vibrato Arm", inventors Page and Schaller now U.S. Pat. No. 4,604,936. The tremolo arm has wrenches in opposite ends thereof, one fitting within a handle that screws onto the outer end of the arm, the other projecting downwardly from a portion of the arm 60 that is within the guitar body. Such wrenches are externally hex-shaped and seat into the various socket holes in set screw 31, clamp bolt 25 etc., to operate the same after the arm has been snapped out of its socket. One of such wrenches, the one at the lower end of the arm 60 (within the guitar body when the arm is in playing position) is shown in said application filed on even date for a "Tremolo Spring Adjustment Mechanism for Electric Guitars", inventor Gressett.

Referring again to the tremolo axis for plate 15, this is both relatively far rear (to the right of FIG. 1) and very high in comparison to the length of the cranks or arms 57. There is a very short torque arm or moment arm between string 29 and the pivot axis for tremolo plate 15 when the plate is not actuated, that is to say, is in the balanced or floating position of FIG. 3. Because of this high mechanical advantage that the spring 58 has relative to the moment created by each string 29, even strong bending of a string 29 does not tend to effect any substantial pivoting of the tremolo plate away from its balanced position. Thus, there is little or no cross talk between the strings even during bending of one or more of the strings.

Stated in positive terms, the moment arm of the spring, relative to the pivot axis of the tremolo plate, is at least nine times that of the strings, when the plate is floating (not actuated).

Referring particularly to FIG. 1, it is pointed out that the slots 26 etc., are so located that the individual elements 18 may be adjusted very far forwardly, so far forwardly that the intonation point on saddle 22 is sometimes forward of the pivot axis of the tremolo plate as viewed in FIG. 1. Others of the intonation points are at the axis as viewed in FIG. 1, while others are behind it. The location of the intonation points near the axis, as viewed in plan (FIG. 1), creates a relationship by which tilting of the tremolo plate by pressing on arm 60 creates less elevation of the intonation points when the arm 60 is depressed (and tremolo plate 15 accordingly pivotally upwardly from the FIG. 3 position to that of FIG. 7).

There has thus been described a tremolo apparatus incorporating both individual string-height adjustment, and fine tuning. One that creates minimized cross talk between the strings, and stays flat for hand support no matter what the setting is for fine tuning. The strings may not lift off the intonation points even when the plate pivots upwardly very far, and friction is minimized so that the plate returns accurately to zero position.

The foregoing detailed description is to be clearly understood as given by way of illustration and example only, the spirit and scope of this invention being limited solely by the appended claims.

What is claimed is:

1. In combination with an electric guitar having a body, neck, and string extending over said body and neck, fine tuning bridge means for effecting separate fine tuning of each individual one of said strings, said fine tuning bridge means comprising:

(a) a plate mounted on said body, (b) a plurality of saddles mounted on said plate, there being one saddle for each individual guitar string, (c) an internally-threaded screw head for each of said guitar strings, (d) means to capture each screw head to permit it to rotate while preventing it from moving longitudinally in response to such rotation, (e) a screw threadedly associated with each screw head and extending downwardly therefrom, (f) means to prevent each screw from rotating while permitting it to move axially in response to rotation of the associated screw head, and (g) means responsive to such axial movement of each screw to effect fine tuning of guitar strings extended over said saddles, there being one means (g) for each string and each screw, so that each string may be individually fine tuned.

2. The invention as claimed in claim 1, in which the upper surfaces of said screw heads are large and flat and lie in substantially the same plane, whereby the guitarist may rest his hand or forearm thereon during playing.

3. The invention as claimed in claim 1, in which said means (g) comprises a lever having a tail portion disposed beneath each screw (e), said lever being connected to a guitar string at a point spaced farther from the guitar neck than is the associated saddle.

4. The invention as claimed in claim 3, in which spring means are provided in engagement with the underside of each lever at said tail end thereof, and in which a support plate is connected to said plate and extends beneath said spring and provides a seat therefor.

5. The invention as claimed in claim 1, in which means are provided to effect pivotal connection between said plate and said body, in which a tremolo arm is connected to said plate, and in which spring means are connected to said plate to counteract the tension of said strings.

* * * * *